US006814315B2

(12) United States Patent
Gould et al.

(10) Patent No.: US 6,814,315 B2
(45) Date of Patent: Nov. 9, 2004

(54) LIQUID DISPENSING MANIFOLD WITH ADJUSTABLE SLIDE PLATE

(75) Inventors: Mark Aaron Gould, Gainesville, GA (US); Kenneth Jones, Smyrna, GA (US)

(73) Assignee: Nordson Corporation, Westlake, OH (US)

( * ) Notice: Subject to any disclaimer, the term of this patent is extended or adjusted under 35 U.S.C. 154(b) by 253 days.

(21) Appl. No.: 09/943,332

(22) Filed: Aug. 30, 2001

(65) Prior Publication Data

US 2003/0042271 A1 Mar. 6, 2003

(51) Int. Cl.[7] ..... B05B 15/08
(52) U.S. Cl. ..... 239/587.1; 118/323
(58) Field of Search ..... 118/323, 680; 156/538, 578; 222/320, 537; 239/587.1; 137/884

(56) References Cited

U.S. PATENT DOCUMENTS 5,094,398 A * 3/1992 Jeter et al. ..... 239/134
5,271,794 A * 12/1993 Jarrell et al. ..... 156/538
6,358,322 B1 * 3/2002 Pahl ..... 118/323

OTHER PUBLICATIONS

Drawing: Slide Plate Assy; Part No.: 305453; Rev: A02; Undated.
Drawing: Slide Plate Assy; Part No.: 305506; Rev: Aa03; Undated.

* cited by examiner

*Primary Examiner*—Ehud Gartenberg
*Assistant Examiner*—Melvin A. Cartagena
(74) *Attorney, Agent, or Firm*—Wood, Herron & Evans, L.L.P.

(57) ABSTRACT

A liquid dispensing apparatus and method that provides for precise adjustment of one or more dispensing modules relative to a substrate. The liquid dispensing apparatus and method includes a manifold which has a liquid discharge orifice that is adapted to connect to a source of liquid, such as adhesive. The manifold further has an elongated slot which has a plurality of walls and a recess portion formed in one of those walls. A mounting block has a flange portion that is disposed in and cooperating with the recess portion of the slot so that the mounting block is retained in and selectively slidable along the slot. A dispensing module with a liquid passageway is removably affixed to the mounting block with the liquid passageway in fluid communication with the liquid discharge orifice in the manifold.

8 Claims, 4 Drawing Sheets

LIQUID DISPENSING MANIFOLD WITH ADJUSTABLE SLIDE PLATE

FIELD OF THE INVENTION

The present invention generally relates to liquid dispensing apparatus and, more specifically, to liquid dispensing manifolds with adjustable slide plates.

BACKGROUND OF THE INVENTION

Some manufacturing processes involve depositing a liquid, such as an adhesive, onto a substrate, such as a nonwoven web. Typically, the liquid is dispensed from a liquid dispensing apparatus that includes a liquid dispensing module coupled to a liquid manifold which is connected to a source of adhesive. In some manufacturing applications, such as in the manufacture of multilayer diapers, two spaced-apart liquid dispensing modules are coupled to a common liquid manifold, thereby allowing adhesive to be deposited onto the opposing edges of a substrate, such as one layer of the diaper. To ensure proper adhesion between the multiple layers of the diaper, the adhesive must be accurately positioned onto the edges of the various layers making up the diaper. Accordingly, the two liquid dispensing modules must be precisely spaced apart from one another. With prior liquid dispensing apparatus, however, precisely spacing apart the liquid dispensing modules is time consuming and labor intensive.

In prior liquid dispensing apparatus, each of the two liquid dispensing modules couples to respective mounting blocks which are selectively moveable along a slot in the liquid manifold. During the initial set-up of the liquid dispensing apparatus, the location of the mounting blocks along the slot in the liquid manifold is initially estimated so that the liquid is deposited along the edges of the substrate. Once in place, the mounting blocks are secured to the slot by an appropriate fastener, such as a set screw. If the initial location of the liquid dispensing modules is incorrect, thereby dispensing liquid onto the wrong part of the substrate, the liquid dispensing process must be stopped, the fastener holding the mounting blocks must be released, and the mounting blocks manually repositioned along the slot in the liquid manifold. Then the mounting blocks must again be fixedly secured to the slot.

Because the mounting blocks are secured to the slot in the manifold using fasteners such as set screws, the location of the mounting blocks cannot be readily changed during the liquid dispensing process. Instead, if repositioning is required, the entire production line must be shut down, and the liquid dispensing modules be manually repositioned. Manually repositioning the liquid dispensing modules has other drawbacks. For instance, the accuracy with which the liquid dispensing modules can be manually aligned over the substrate varies depending on the technician setting up the liquid dispensing apparatus.

Repositioning and aligning the liquid dispensing modules becomes an even greater issue when the liquid dispensing apparatus is used on a production line capable of fabricating different products having a range of widths. For example, a production line may be used to produce diapers having differing widths to accommodate children of different sizes, e.g., new born, infants, and toddlers. In this situation, the liquid dispensing modules must be manually repositioned each time the diaper style changes in order to accommodate the different widths. Thus, the cumbersome task of repositioning the liquid dispensing modules must be repeated each time the product style, and thus width, changes. Consequently, the down time and expense associated with each product changeover may be significant.

What is needed, therefore, is a liquid dispensing apparatus that permits the liquid dispensing modules to be more precisely positioned so the dispensed liquid engages the desired portion of the substrate. The liquid dispensing apparatus should also provide for repositioning the liquid dispensing modules to significantly reduce the down time of the entire manufacturing process while the alignment process occurs.

SUMMARY OF INVENTION

The present invention provides a liquid dispensing apparatus that provides for precise adjustment of one or more dispensing modules relative to a substrate. In addition, the liquid dispensing apparatus significantly reduces the time required for systematic adjustment of the dispensing modules. In accordance with the principles of the invention, the liquid dispensing apparatus includes a manifold which has a liquid discharge orifice that is adapted to connect to a source of liquid, such as adhesive. The manifold further has an elongated slot which has a plurality of walls and a recess portion formed in one of those walls. A mounting block has a flange portion that is disposed in and cooperating with the recess portion of the slot so that the mounting block is retained in and selectively slidable along the slot. A dispensing module with a liquid passageway is removably affixed to the mounting block with the liquid passageway in fluid communication with the liquid discharge orifice in the manifold.

The liquid dispensing apparatus may also include a slide plate disposed between the mounting block and the dispensing module. Moreover, the slot in the manifold may include a second recess portion in another of the walls in the slot which is oppositely disposed to the first recess portion. Accordingly, the mounting block has a second flange member disposed in and cooperating with the second recess portion to further retain the mounting block in the slot.

In another embodiment, the liquid dispensing apparatus includes a manifold with a liquid discharge orifice adapted to connect to a source of liquid and a mounting block slidably mounted to the manifold. A dispensing module is removably affixed to the mounting block and has a liquid passage way in fluid communication with the liquid discharge orifice in the manifold. A driven adjustment member is coupled to the mounting block and is selectively operative to slidingly move the mounting block along the manifold. Preferably, the adjustment member includes a threaded rod threadingly coupled to the mounting block.

While the two liquid dispensing apparatus described above include only a single mounting block and dispensing module, it will be appreciated that the liquid dispensing apparatus may include a plurality of dispensing modules mounted respective to a plurality of mounting blocks, each of which is independently movable relative to the manifold.

The invention also contemplates a method for adjusting the location of a dispensing module dispensing liquid onto a substrate where the dispensing module is coupled to a mounting block slidably mounted to a manifold, and a selectively driven adjustment member is coupled to the mounting block. First, the adjustment member is operated so as to slidingly move the mounting block along the manifold such that liquid discharged from the dispensing module contacts the substrate in a predetermined location. After the liquid is discharged in the desired location, the adjustment member is secured so that the mounting block is no longer free to slide along the manifold.

Various additional advantages and features of the invention will become more readily apparent to those of ordinary skill in the art upon review of the following detailed description taken in conjunction with the accompanying drawings.

DETAILED DESCRIPTION OF DRAWINGS

DETAILED DESCRIPTION OF PREFERRED EMBODIMENTS

Figures 1, 1A:
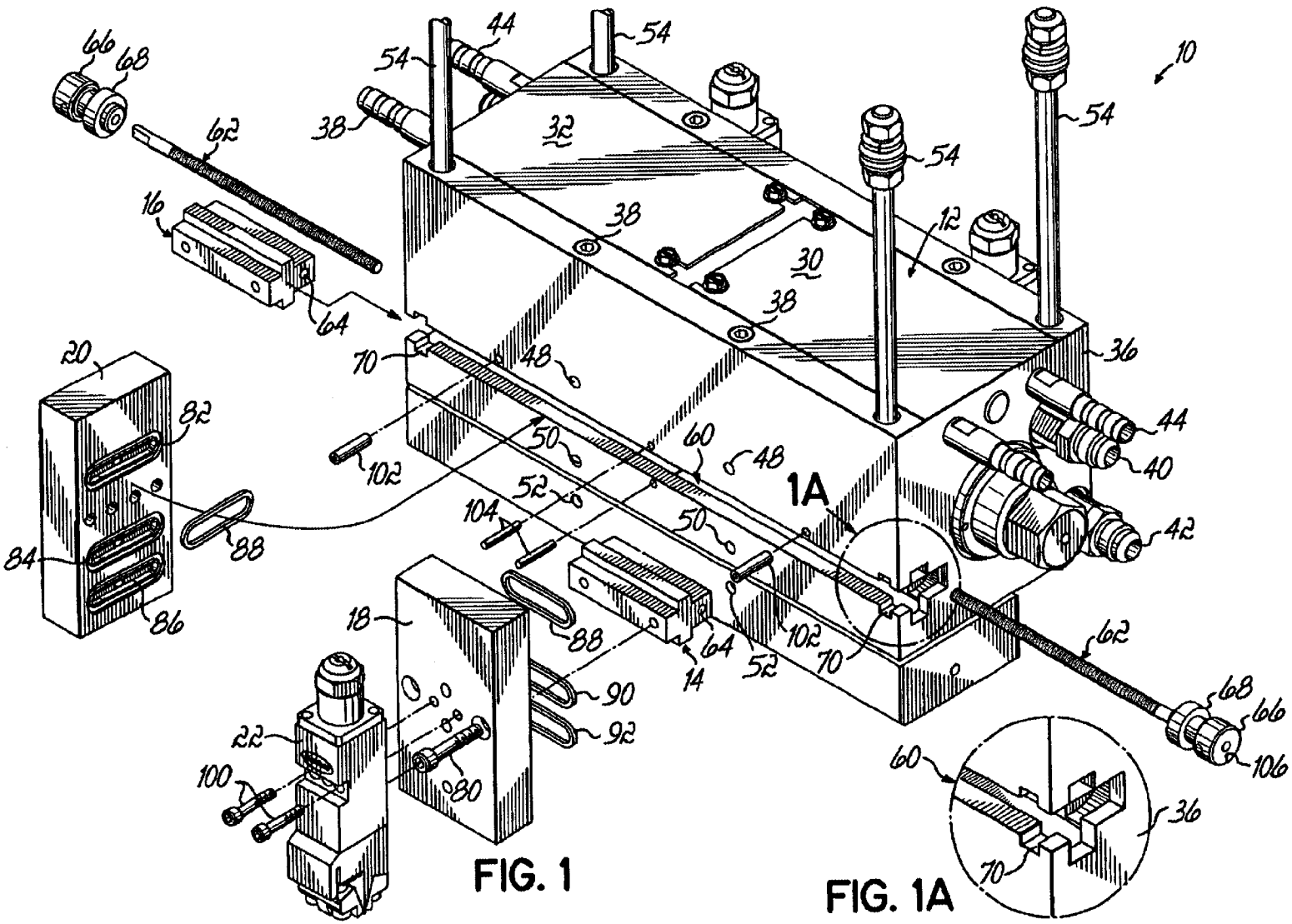
FIG. 1 is a disassembled perspective view of one embodiment of the liquid dispensing apparatus of the invention.
FIG. 1A is an enlarged view of the encircled portion 1A of FIG. 1.
Figure 2:
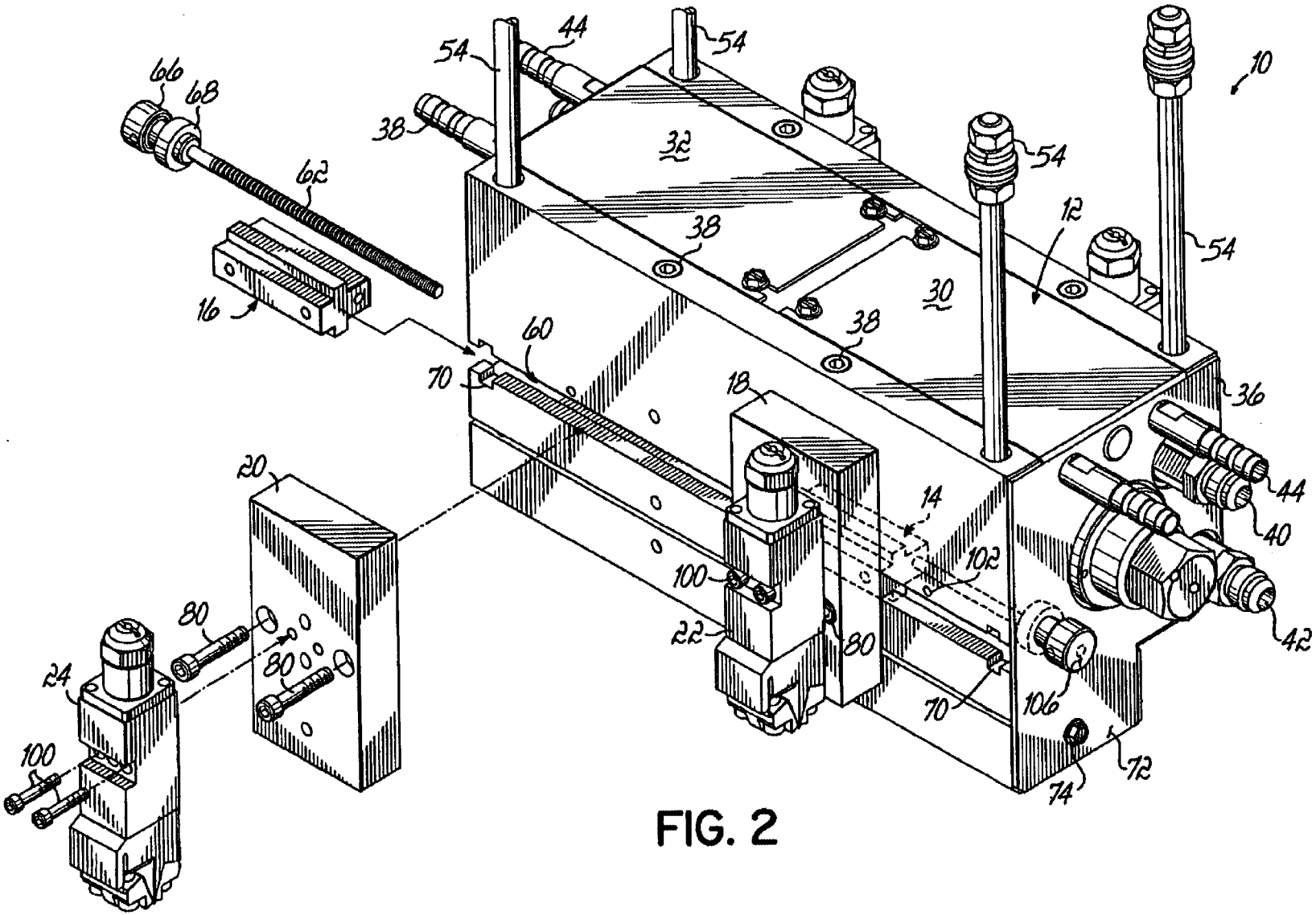
FIG. 2 is a partially disassembled perspective view of the liquid dispensing apparatus of FIG. 1.
Figure 3:
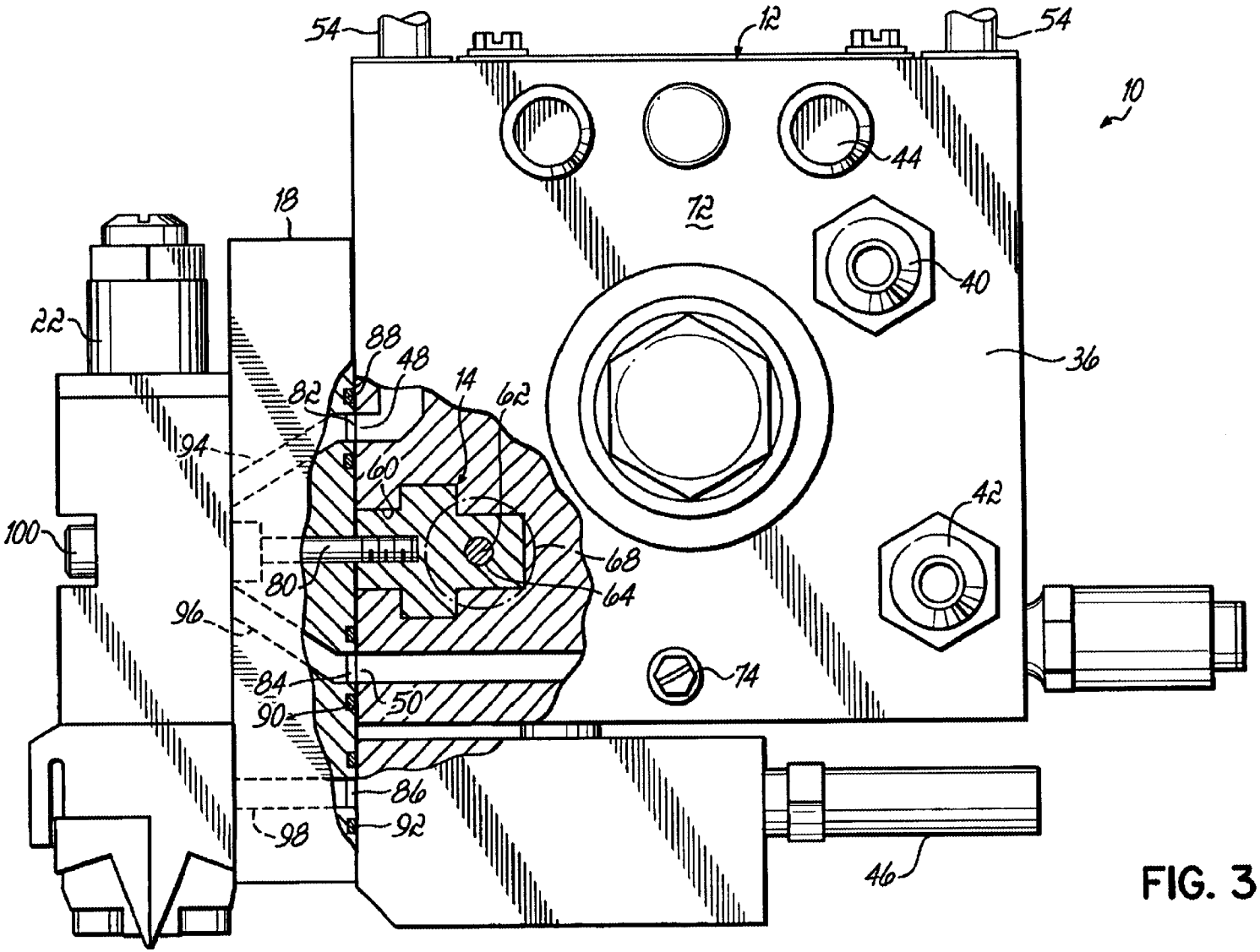
FIG. 3 is a side elevation view with partial cutaway of the assembled liquid dispensing apparatus FIG. 1.
Figure 4:
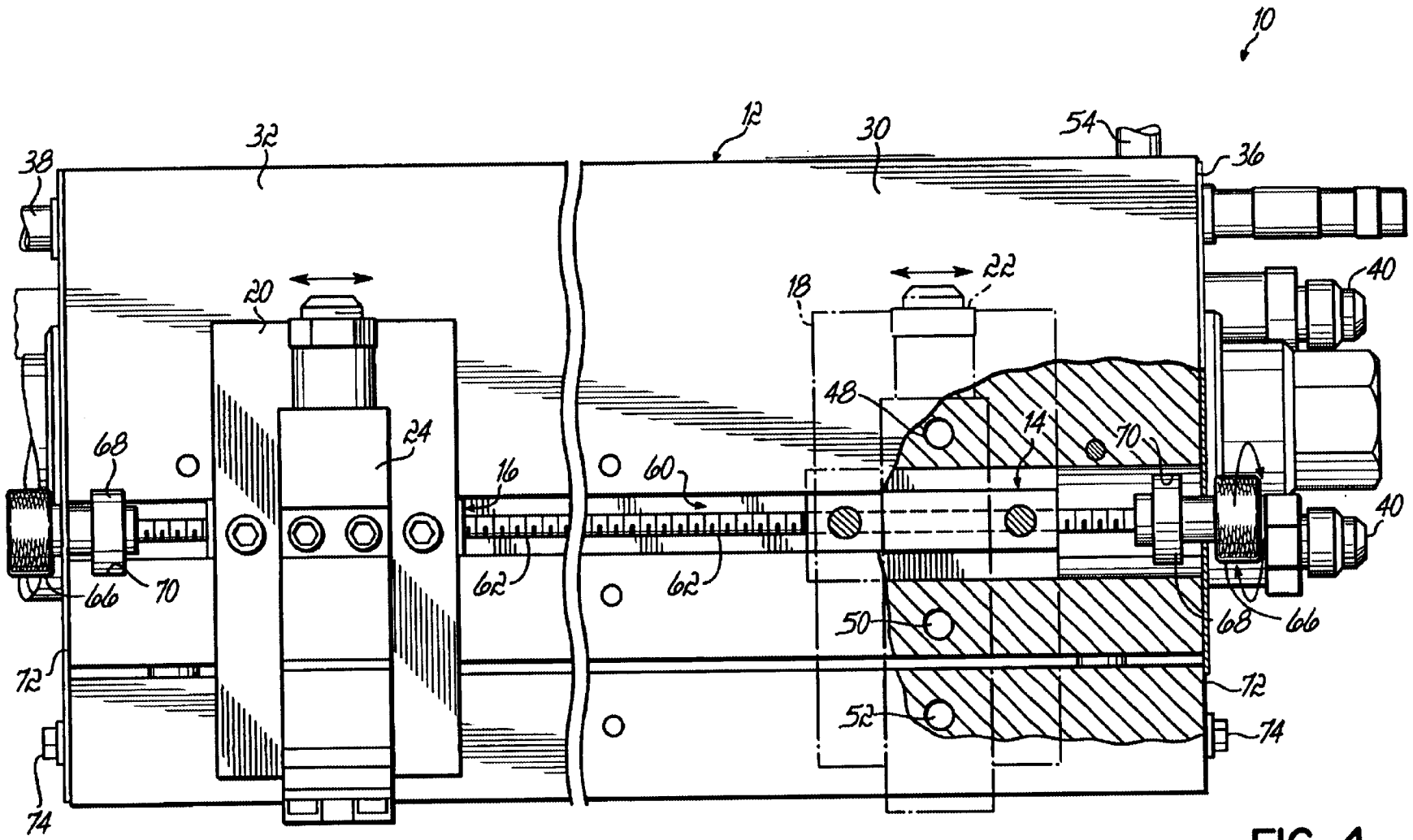
FIG. 4 is a front elevational view with partial cutaway of the assembled liquid dispensing apparatus of FIG. 1.

With reference to FIGS. 1 and 2, one embodiment of a liquid dispensing apparatus 10 of the invention is shown and includes a manifold 12, two mounting blocks 14, 16, two slide plates 18, 20, and two dispensing modules 22, 24. While the liquid dispensing apparatus 10 is shown with two dispensing modules 22, 24, the principles of the invention are also applicable to any liquid dispensing apparatus having one or more dispensing modules. Furthermore, the manifold 12 illustrated in the embodiment shown in FIGS. 1–4 is comprised of two operative halves 30, 32 which are structurally and functionally similar to each other. The description below, which addresses only half 30 of the manifold 12, is applicable to the other half 32.

The top of manifold 12 includes air inlets 38 which are adapted to connect to a source of pressurized control air (not shown). End 36 of the manifold 12 includes a liquid inlet 40 and a liquid outlet 42 adapted to connect to a source of recirculating liquid (not shown); and an electrical coupling 44 to receive a cord set associated with the line supplying the liquid to the manifold 12. The manifold 12 includes another air inlet 46 (FIG. 3) adapted to connect to a source of pattern air (not shown). The air inlet 38, the liquid inlet 40, and the air inlet 46 are in fluid communication respectively with discharge orifices 48, 50, 52 disposed on the broad side of the manifold 12. The manifold 12 further includes attachment posts 54 used to mount the liquid dispensing apparatus 10 during the liquid dispensing process.

With reference to FIGS. 1–4, the manifold 12 includes a slot 60 which extends lengthwise from one end of the manifold 12 to the other. The slot 60 has a T-shaped cross section so as to slidingly receive mounting blocks 14, 16 which have a corresponding T-shaped cross section. After mounting block 14 is inserted into slot 60 a driven adjustment member 62, such as a threaded rod, is inserted into a threaded throughhole 64 rearwardly disposed in mounting block 14. A knob 66 having a flange portion 68 is located at the free end of the threaded rod 62. The flange portion 68 is placed in a second slot 70 (FIG. 1A) which extends perpendicularly to slot 60. An end plate 72 (FIG. 2) is secured to the end 36 of the manifold 12 with fastener 74 to keep the knob 66 from slipping out of slot 70. Because the threaded rod 62 is fixed relative to the slot 60, mounting block 14 can be repositioned along slot 60 by turning the knob 68 which turns threaded rod 62. As such, the mounting block 14 moves along the threaded rod 62.

After the mounting block 14 is operatively positioned in slot 60, slide plate 18 is secured to mounting block 14 with two fasteners 80. Slide plate 18 has three slots 82, 84, 86 in the face of the slide plate 18 which faces the manifold 12. Three gaskets 88, 90, 92 surround the slots 82, 84, 86 to prevent leakage of liquid or air as they pass from the manifold 12 to the slide plate 18. One particular gasket suited for use as gaskets 88, 90, 92 is sold under the Rulon trademark. The slide plate 18 further includes interior passageways 94, 96, 98 which connect respectively to slots 82, 84, 86 to transport control air, liquid, and pattern air from respective discharge orifices 50, 52, 54 to the dispensing module 22. With the slide plate 18 secured to mounting block 14, dispensing module 22 is secured to slide plate 18 with two fasteners 100.

Set screws 102 and pins 104 restrict the travel of the mounting block 14 so that the discharge orifices 50, 52, 54 remain in fluid communication with the slots 82, 84, 86 in slide plate 18. Without set screws 102 and pins 104 to restrict the travel of mounting block 14, the slide plate 18 could be moved along slot 60 so that the discharge orifices 50, 52, 54 are not in fluid communication with the slots 82, 84, 86. If that occurred, the dispensing module 22 may become starved for air or liquid, and likely disrupt the liquid dispensing process. Additional set screws 102 may be used to act as stops so that the operator can readily adjust the dispensing module 22 to a predetermined location for a particular manufacturing process. In other words, if the liquid dispensing apparatus 10 is to be used in the manufacture of diapers, for instance, of varying widths, set screws 102 could be moved to different holes in the manifold 12 to track the change in product width. Of course, the position of the dispensing module 12 would still be adjustable with set screws 102 helping to facilitate the changeover process.

To further assist in aligning the dispensed liquid onto the product, knob 66 includes an indicator mark, such as an arrow head, 106. Preferably, the threaded rod has a thread pitch 32 threads per inch. Accordingly, when the knob 66 is turned one full revolution as evidenced by the indicator mark 106, the mounting block and, more importantly, the dispensing module 22 moves 1/32nd of an inch along the slot 60. As such, the operator can precisely move the dispensing module 22 relatively to the slot 60 by simply turning the knob 66 an appropriate number of turns to achieve a desired amount of linear travel along the slot 60. Knowing the amount of linear travel resulting from a certain number of turns of knob 66 may be useful when the dispensing module 22 must be adjusted during the dispensing process. Once the dispensing module 22 is properly positioned and the liquid is being dispensed where desired, the threaded rod 62 or the knob 66 is locked down in an appropriate manner to ensure that the dispensing module 22 does not move during the dispensing process.

While the present invention has been illustrated by a description of various preferred embodiments and while these embodiments have been described in considerable detail in order to describe the best mode of practicing the invention, it is not the intention of applicants to restrict or in any way limit the scope of the appended claims to such detail. Additional advantages and modifications within the spirit and scope of the invention will readily appear to those skilled in the art. The invention itself should only be defined by the appended claims, wherein we claim:

What is claimed is:

1. A liquid dispensing apparatus comprising:

a manifold having a front side with a length, a liquid discharge orifice adapted to connect to a source of liquid, and a slot opening on said front side and extending along said length;

a mounting block having a portion mounted within said slot for sliding movement along said manifold;

a dispensing module removably affixed to said mounting block and having a liquid passageway in fluid communication with said liquid discharge orifice; and an adjustment member extending along said length and into said slot, said adjustment member coupled to said portion of said mounting block and selectively operative to drive said mounting block and said dispensing module with the sliding movement along said manifold.

2. The liquid dispensing apparatus of claim 1, wherein said mounting block includes a rearward extension and said adjustment member is coupled to said rearward extension.

3. The liquid dispensing apparatus of claim 1, wherein said mounting block includes a threaded passage and said adjustment member comprises a threaded rod received in said threaded passage.

4. The apparatus of claim 3, further comprising a recess portion extending along said length and communicating with said slot, and wherein said mounting block further comprises a flange portion and a rearward extension, said threaded passage extending within said rearward extension and said flange portion positioned within said recess portion to retain said mounting block within said slot.

5. A liquid dispensing apparatus comprising:

a manifold having a front side with a length, first and second liquid discharge orifices adapted to connect to a source of liquid, and a slot opening on said front side and extending along said length;

first and second mounting blocks, each mounting block having a portion mounted within said slot for sliding movement along said manifold;

first and second dispensing modules removably affixed respectively to said first and second mounting blocks, said first and second dispensing modules having respective liquid passageways in fluid communication with said first and second liquid discharge orifices; and first and second adjustment members extending along said length and into said slot, said first and second adjustment members respectively coupled to said first and second mounting blocks and selectively operative to drive said respective first and second mounting blocks and said first and second dispensing modules with the sliding movement along said manifold.

6. The liquid dispensing apparatus of claim 5, wherein each of said first and second mounting blocks includes a rearward extension and said first and second adjustment members are coupled the rearward extensions.

7. The liquid dispensing apparatus of claim 5, wherein said first and second mounting blocks each include a threaded passage and each of said first and second adjustment members comprises a threaded rod received in a respective one of said threaded passages.

8. The apparatus of claim 5, further comprising a recess portion extending along said length and communicating with said slot, and wherein said mounting blocks each further comprises a flange portion and a rearward extension, said threaded passages respectively extending within said rearward extensions and said flange portions respectively positioned within said recess portion to retain said mounting blocks within said slot.

* * * * *